United States Patent [19]

Lapid

[11] Patent Number: 4,702,719

[45] Date of Patent: Oct. 27, 1987

[54] DEVICE FOR SUSPENDING INFANT TOYS

[75] Inventor: Aharon M. Lapid, Shimshon, Israel

[73] Assignee: Tzora Furniture Industries Ltd., Bet Shemesh, Israel

[21] Appl. No.: 784,195

[22] Filed: Oct. 4, 1985

[30] Foreign Application Priority Data

Oct. 26, 1984 [IL] Israel ..... 73327

[51] Int. Cl.[4] ..... A63H 33/00; E05D 11/06; A47D 15/00

[52] U.S. Cl. ..... 446/227; 16/374; 248/107

[58] Field of Search ..... 16/374; 248/105, 106, 248/107; 446/227

[56] References Cited

U.S. PATENT DOCUMENTS

| | | | |
|---|---|---|---|
| 1,082,808 | 12/1913 | Hubbard | 248/106 |
| 1,657,211 | 1/1928 | Henritzy | 16/374 |
| 2,434,440 | 1/1948 | Schafranek | 248/106 |
| 2,496,527 | 2/1950 | Forrest | 248/107 |
| 2,558,583 | 6/1951 | Robins | 16/374 X |
| 2,717,753 | 9/1955 | Schweikert | 248/106 |
| 2,737,311 | 3/1956 | Blacher | 16/374 X |
| 3,222,020 | 12/1965 | Rea | 248/106 |
| 4,188,745 | 2/1980 | Harvey et al. | 446/227 |
| 4,561,549 | 12/1985 | Yokohori | 248/105 X |

FOREIGN PATENT DOCUMENTS 0179732 4/1986 European Pat. Off. ..... 446/227

*Primary Examiner*—Robert A. Hafer
*Assistant Examiner*—D. Neal Muir
*Attorney, Agent, or Firm*—Benjamin J. Barish

[57] ABSTRACT

An infant's amusement device comprises a suspension bar adapted to be supported in a horizontal position during use for suspending a plurality of toys therefrom, a pair of supporting bars disposed in a common plane at the opposite ends of the suspension bar, and a pair of juncture bars joining the supporting bars to the opposite ends of the suspension bar and lying in a common plane with the suspension bar. The latter common plane is at an acute angle of 30°-75° to the common plane of the supporting bars, whereby the supporting bars stably support the suspension bar in a horizontal position on and spaced above a horizontal surface to enable the infant to lie under the suspension bar, parallel to and straddled by the supporting bars, and to touch the toy suspended from the suspension bar. Three embodiments are described, namely a unitary construction, a foldable three-part construction, and a foldable five-part construction.

7 Claims, 6 Drawing Figures

FIG 1
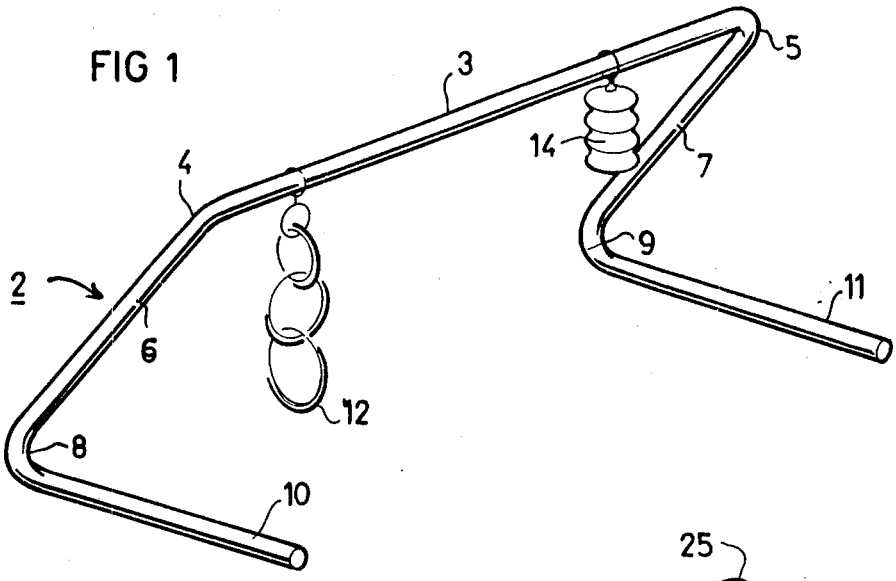
FIG. 2
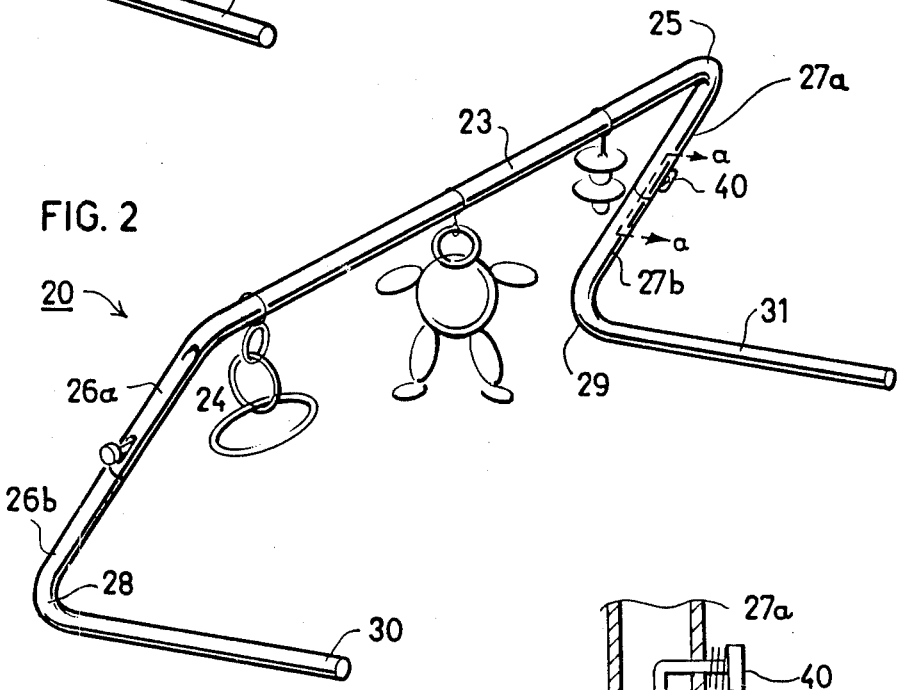
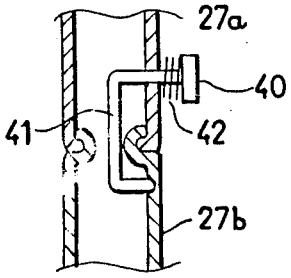
FIG 2a

FIG. 3
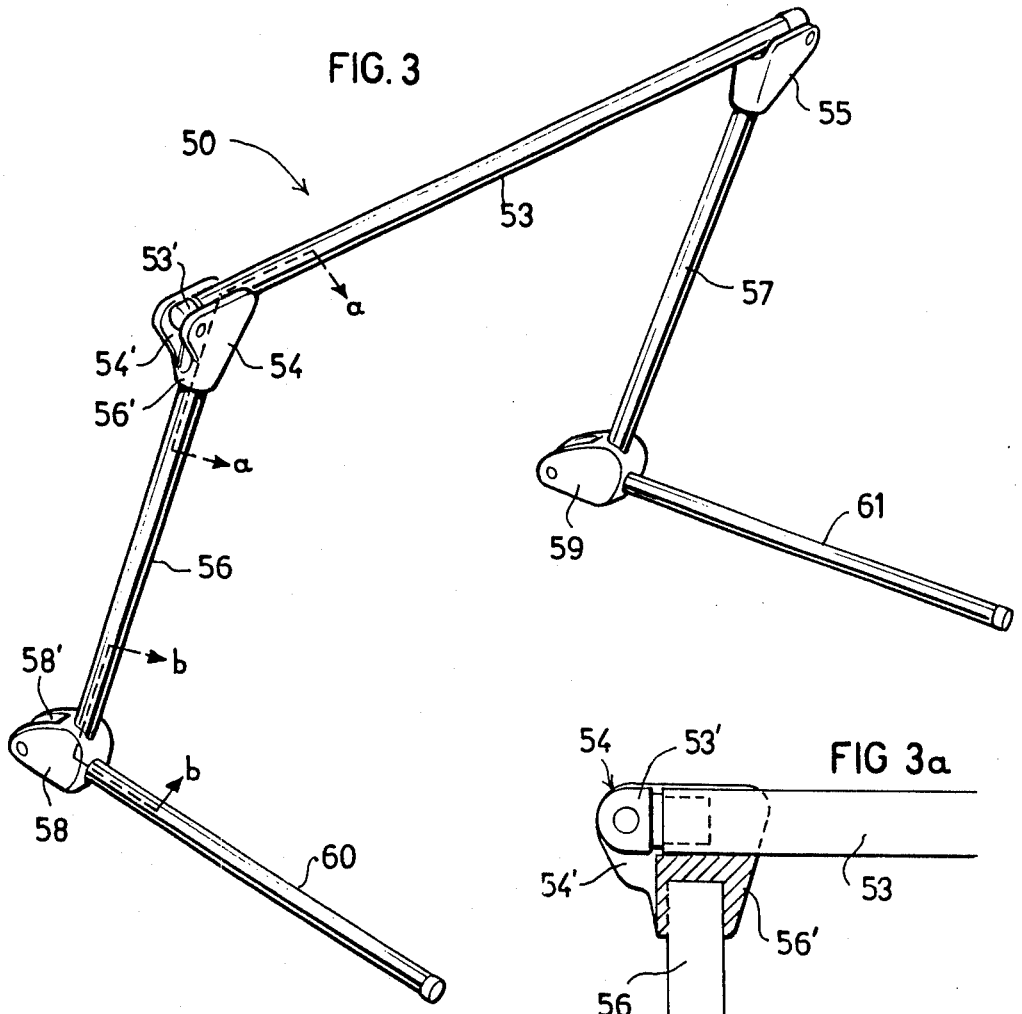
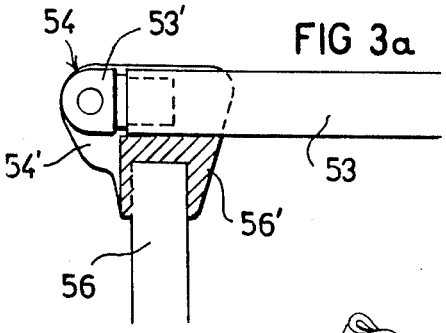
FIG 3a
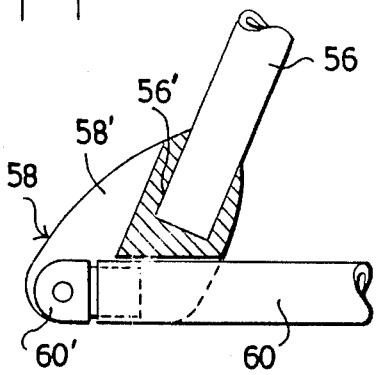
FIG 3b

DEVICE FOR SUSPENDING INFANT TOYS

BACKGROUND OF THE INVENTION

The present invention relates to an infant's amusement device, and particularly to the type of device including a suspension bar for suspending a plurality of typs which can be touched and moved by the infant to attract his attention.

Infants amusement devices of the foregoing type are known and are commonly provided as an attachement to an infant's carriage, e.g. by the use of clamps or the like. The suspension bar is attached to the carriage so as to overlie the infant and to enable the infant, while lying on his back, to see the suspended toys as they are moved by the motion of the carriage or by touching by the infant.

An object of the present invention is to provide an infant's amusement device of the foregoing type which can be used to amuse or attract the attention of the infant when the infant is not only in a carriage but is also on a floor or any other horizontal surface.

SUMMARY OF THE INVENTION

According to a broad aspect of the present invention, there is provided an infant's amusement device comprising a suspension bar adapted to be supported in a horizontal position during use for suspending a plurality of toys therefrom; a pair of supporting bars disposed in a common plane at the opposite ends of said suspension bar; and a pair of juncture bars joining the supporting bars to the opposite ends of the suspension bar and lying in a common plane with the suspension bar, which common plane is at an acute angle to that of the supporting bars, whereby the supporting bars stably support the suspension bar in a horizontal position on and spaced above a horizontal surface to enable an infant to lie on his back under the suspension bar, parallel to and straddled by the supporting bars, for touching the toys suspended from the suspension bar.

In the preferred embodiments of the invention described below, the supporting bars are parallel to each other and perpendicular to the suspension bar; also, the acute angle between the plane of the supporting bars and the plane of the suspension bar and juncture bars is 30°–75°, preferably about 45°.

In one described embodiment, the device is constituted of a unitary tube formed with bends at its opposite ends to define the juncture bars, which juncture bars are formed with further bends to define the supporting bars.

In a second described embodiment, the device is constituted of a three-part tube construction including a middle part defining the suspension bar and a portion of the juncture bars, and two end parts defining the remaining portions of the juncture bars and the supporting bars, each of the two end parts being pivotable above the longitudinal axis of their respective juncture bars for folding the device into a compact form for handling or storage.

A third embodiment is also described wherein the device is of a five-part construction including a middle part defining the suspension bar, a first pair of further parts each hinged by a first pair of hinges at one end to the ends of the suspension bar and defining the juncture bars, and a second pair of further parts each hinged by a second pair of hinges, to the opposite ends of the juncture bars and defining the supporting bars, the second pair of hinges being formed with flat bottom faces to aid in stablely supporting the device on a flat horizontal surface in the open condition of the device, the five parts being foldable at the hinges to provide a compact arrangement for storage or handling. The first pair of hinges permit pivotable movement of the respective juncture bars to the suspension bar only about axes perpendicular to the suspension bar; and the second pair of hinges permit pivotable movement of the juncture brs to the supporting bars only about axes parallel to the suspension bar, thereby firmly bracing the suspension bar from displacement along its longitudinal axis. In addition, each of the second pair of hinges includes stop surfaces limiting the pivoted position of the suspension bar to overlie an intermediate portion of the supporting bars, thereby stably supporting the suspension bar on the horizontal surface.

Further features and advantages of the invention will be apparent from the description below.

BRIEF DESCRIPTION OF THE DRAWINGS

The invention is herein described, by way of example only, with reference to the accompanying drawings, wherein:

FIG. 1 illustrates one form of infant's amusement device constructed in accordance with the present invention;

FIG. 2 illustrates another form of the amusement device constructed in accordance with the invention; and FIG. 2*a* is an enlarged sectional view along lines a—a of FIG. 2 illustrating the constructions of one of the two pivotal connections in the device of FIG. 2;

FIG. 3 illustrates a third form of amusement device constructed in accordance with the invention; and FIGS. 3*a* and 3*b* are enlarged sectional views along lines a—a and b—b, respectively, of FIG. 3.

DESCRIPTION OF PREFERRED EMBODIMENTS

The Embodiment of FIG. 1

With reference to FIG. 1, therein illustrated is an infant's amusement device, generally designated 2, of a unitary or one-piece tubular construction. The illustrated device 2 is in the form of a bent tube having a main section 3 formed at its opposite ends with bends 4 and 5 to define two parallel sections 6 and 7. The opposite ends of the latter sections are formed with further bends 8 and 9 to define two further parallel sections 10 and 11.

The main section 3 of the bent tube is straight and serves as a suspension bar for suspending a plurality of toys 12, 14. The end sections 10 and 11, which are parallel to each other and therefore lie in a common plane, serve as supporting bars for stably supporting suspension bar 3 on the floor or other horizontal surface. The intermediate sections 6 and 7 define juncture bars between the suspension bar 3 and the supporting bars 10 and 11. Juncture bars 6 and 7 lie in a common plane with suspension bar 3, which plane is at an acute angle, defined by the angle of bends 8 and 9, from the plane of supporting bars 10 and 11. This acute angle of bends 8 and 9 is preferrably 30°–75°;

It will thus be seen that device 2 illustrated in FIG. 1 may be placed on any horizontal surface, such as the floor, and is stably supported on the horizontal surface by supporting bars 10 and 11.

It will also be seen that be seen that juncture sections 6 and 7 space the suspension bar 3 above the supporting horizontal surface, so that when the infant is lying on his back straddled by the supporting bars 10, 11, the suspension bar is supported vertically over the infant with the suspended toys 12, 14 within easy reach of the infant's hands. Great stability to the device is provided by the acute angle between the plane of suspension bar 3 and the juncture bars 6 and 7 with respect to the plane of the supporting bars 10 and 11. As indicated above, this acute angle is determined by the angle of bends 8 and 9 which is preferably between 30°–60°, for example about 45°.

The Embodiment of FIGS. 2 and 2*a*.

FIGS. 2 and 2*a* illustrate an amusement device similar to that of FIG. 1 but of a three-part construction in order to permit the device to be collapsed into a compact form for handling or storage. Thus, the device 20 illustrated in FIG. 2 comprises a suspension bar 23 which includes a pair of supporting bars 30, 31 joined by juncture bars to the opposite ends of the suspension bar . In this case, however, each juncture bar is split into two sections, namely sections 26*a*, 26*b* joining supporting bar 30 to one side of the suspension bar 23 via bends 24, 28, and sections 27*a*, 27*b* joining supporting bar 31 to the opposite side of the suspension bar via bends 25, 29.

It will thus be seen that the amusement device 20 in FIG. 2 is of a three-part construction including a middle part defining suspension bar 23 and sections 26*a*, 27*a* of the junctures, and two end parts defining the remaining sections 26*b*, 27*b* of the junctures and the two supporting bars 30, 31.

The two end parts are pivotable about the longitudinal axis of the respective juncture section for folding the device into a compact form for purposes of handling or storage. This is more particularly illustrated in FIG. 2*a*, wherein it will be seen that the lower juncture section 27*b* is telescopically received within the end of the upper juncture section 27*a* so as to permit the lower section to be rotated along the longitudinal axis of both juncture sections to bring supporting bars 30, 31 into the same plane as the suspension bar 23 for handling or storage when the device is not in use.

Any suitable means may be used for retaining the device in its open position as illustrated in Fig. 2, or for releasing the device to permit the end parts including the legs sections 30, 31 to be pivoted to a folded compact condition. FIG. 2*a* illustrates the releasable retainer means as including a button 40 received in an opening in the upper juncture section 27*a* and having a stem 41 engageable with the end of the lower juncture section 27*b*. A spring 42 urges button 40 in the direction causing its stem 41 to engage the inner surface of the lower juncture section 27*b*, and thereby to retain the two juncture sections in position. A recess 43 is provided in the inner face of juncture section 27*b* for receiving the free tip of stem 41. When the device is to be folded, button 40 is depressed in order to move its stem 41 out of engagement with the lower juncture section 27*b*. This permits the latter section to be pivoted about its longitudinal axis so as to move supporting bar 31 into the plane of suspension bar 23.

It will be appreciated that a similar spring-release button 43 is provided at the opposite juncture sections 26*a*, 26*b* for folding the opposite supporting bar 30 in the same manner into the plane of suspension bar 23.

The Embodiment of FIGS. 3, 3*a*, 3*b*

FIGS. 3, 3*a*, 3*b* illustrate a five-part construction permitting even more compact folding of the device for handling or storage. This five-part construction, generally designated 50, includes a middle part 53 defining the suspension bar; a pair of hinges 54, 55 at the opposite ends and hingedly joined to a first pair of further parts 56, 57 defining the juncture bars; and a second pair of hinges 58, 59 hingedly joining to the opposite ends of bars 56, 57 to the supporting bars 60, 61.

As shown in FIG. 3*a*, hinge 54 permits bar 56 to be pivoted only about the axis perpendicular to the longitudinal axis of the suspension bar 53, and thereby to be folded to a position parallel to bar 53 in the folded condition of the device, but limits the hinged movements between the two bars to an angle of 90° in the open condition of the device. For this purpose, the hinge is of generally triangular configuration including a socket 56' for receiving bar 56 at one apex of the triangle, a member 53' for pivotably mounting bar 53 at a second apex of the triangle, and a slot 54' extending 270° to permit bars 53 and 56 to pivot perpendicularly to each other in the open condition of the device, as shown in FIG. 3, or against each other in the folded condition of the device. Hinge 55 at the opposite end is of the same construction and permits the same pivotable movement between juncture bar 57 and suspension bar 53.

FIG. 3*b* illustrates the construction of hinge 58 between bars 56 and 60 (and similarly that of hinge 59 between bars 57 and 61). Hinge 58 permits bar 60 to be pivoted only about the axis parallel to the longitudinal axis of the suspension bar 53, and thereby to be folded parallel to bar 56 in the folded condition of the assembly, but limits the hinged opening movement of the bar to define the acute angle between the plane of supporting bars 60, 61 and the plane of the juncture bars 56, 57 and suspension bar 53. As indicated earlier, this angle is preferably within the range of 30°–75°, an angle of about 45° being preferred. Hinge 59 at the opposite end is of the same construction and permits the same pivotable movement between supporting bar 61 and juncture bar 57.

Thus, hinge 58 (and also hinge 59 at the opposite end) is of generally triangular construction and includes: a socket 56'' for receiving bar 56 at one apex; a member 60' pivotably mounted at a second apex for receiving bar 60; and a slot 58' extending 315° to permit bars 56, 60 to pivot to a 45° angle in the open condition of the device or against each other in the closed condition of the device. The bottom faces of hinges 58 and 59 are flat to aid in the stable supporting of the device on a flat horizontal surface in the open condition of the device, while the above described constructions of the two pairs of hinges 54, 55 and 58, 59, firmly support the suspension bar 53 in a horizontal position and brace it against displacement parallel to its longitudinal axis.

In all the other respects, the device illustrated in FIGS. 3, 3*a* and 3*b* is substantially the same in structure and in manner of use as described above with respect to the embodiments of FIGS. 1 and 2.

Preferably, the unitary device illustrated in FIG. 1, the three-part device illustrated in FIG. 2, and the five-part construction illustrated in FIG. 3 are all of a metal tube construction, such as chromium-plated tubing. Plastic tubing, however, may also be used for this purpose.

While the invention has been described with respect to three perferred embodiments, it will be appreciated that many other variations, modifications and applications of the invention may be made.

What is claimed is:

1. An infant's amusement device, comprising:

a suspension bar having a longitudinal axis;

a pair of juncture bars pivotably mounted at one of their ends to the opposite ends of said supporting bar by a first pair of hinges;

and a pair of supporting bars pivotably mounted to the opposite ends of said juncture bars by a second pair of hinges, such that all said bars are foldable to an approximately parallel relationship for storage or transportation, but may be erected to an operative relationship wherein the supporting bars are disposed in a common plane for resting on a horizontal surface, and the suspension bar is disposed in a horizontal position overlying the horizontal surface;

said first pair of hinges including surfaces permitting pivotable movement of the juncture bars only along axes perpendicular to the longitudinal axis of the suspension bar;

said second pair of hinges including surfaces limiting the pivoted position of the juncture bars such that the suspension bar overlies an intermediate portion of the supporting bars, and permitting pivotable movement of the juncture bars with respect to the supporting bars only about axes parallel to the longitudinal axis of the suspension bar, thereby to brace the suspension bar against displacement parallel to its longitudinal axis.

2. An infant's amusement device, comprising:

a suspension bar having a longitudinal axis and adapted to be supported in a horizontal position during use for suspending a plurality of toys therefrom;

a pair of supporting bars disposed at the opposite ends of said suspension bar, said supporting bars being disposed in a common plane;

and a pair of juncture bars joining said supporting bars to said suspension bar and lying in a common plane with said suspension bar, which common plane is at an acute angle to that of said supporting bars;

whereby said supporting bars stably support said suspension bar in a horizontal position on and spaced above a horizontal surface to enable an infant to lie on his back under the suspension bar, parallel to and straddled by the supporting bars, for viewing and touching toys suspended from said suspension bar;

said device being of five-part construction including:

a middle part defining said suspension bar;

a first pair of further parts each hinged, by a first pair of hinges, at one end to the ends of said suspension bar and defining said juncture bars;

said first pair of hinges permitting pivotable movement of the respective junction bars only about axes perpendicular to the longitudinal axis of the suspension bar;

and a second pair of further parts each hinged, by a second pair of hinges, to the opposite ends of said juncture bars and defining said supporting bars;

said second pair of hinges permitting pivotable movement of the juncture bars only about axes parallel to the longitudinal axis of the suspension bar, thereby to brace the suspension bar against displacemnt parallel to its longitudinal axis, said second pair of hinges also being formed with flat bottom faces to aid in stably supporting the device on a flat horizontal surface in the open condition of the device and being further formed with stop surfaces to limit the pivoted positions of the suspension bar to overlie an intermediate portion of said supporting bars;

said five-parts being foldable at the hinges to provide a compact form for handling or storage.

3. The device according to claim 2, wherein said supporting bars are parallel to each other and perpendicular to said suspension bar.

4. The device according to claim 3, wherein said acute angle between the plane of said supporting bars, and the plane of said suspension bar and juncture bars, is 30°–75°.

5. The device according to claim 4, wherein said suspension bar, juncture bars and supporting bars are all of tubular construction.

6. The device according to, claim 2, wherein said first pair of hinges between the suspension bar and the juncture bars include stop surfaces limiting the pivotable movement between the suspension bar and the juncture bars to an angle of 90° in the open condition of the device, said first pair of hinges permitting the juncture bars to be pivoted parallel to the suspension bar in the folded condition of the device.

7. The device according to claim 2, wherein all said bars are of hollow tubular construction.

* * * * *